US008510992B2

(12) United States Patent
Goddard-Watts

(10) Patent No.: US 8,510,992 B2
(45) Date of Patent: Aug. 20, 2013

(54) MECHANISM FOR OPENING AND CLOSING BARRIER

(75) Inventor: James Goddard-Watts, Yeovil (GB)

(73) Assignee: Silverline Tools Limited, Somerset (GB)

( * ) Notice: Subject to any disclaimer, the term of this patent is extended or adjusted under 35 U.S.C. 154(b) by 0 days.

(21) Appl. No.: 13/256,423

(22) PCT Filed: Mar. 11, 2010

(86) PCT No.: PCT/GB2010/000445

§ 371 (c)(1),
(2), (4) Date: Nov. 14, 2011

(87) PCT Pub. No.: WO2010/103282

PCT Pub. Date: Sep. 16, 2010

(65) Prior Publication Data

US 2012/0055093 A1 Mar. 8, 2012

(30) Foreign Application Priority Data

Mar. 13, 2009 (GB) ..... 0904316.7

(51) Int. Cl.
*E05F 13/00* (2006.01)

(52) U.S. Cl.
USPC ..... 49/269; 49/263; 49/272; 49/273

(58) Field of Classification Search
USPC ..... 49/131, 132, 263–274
See application file for complete search history.

(56) References Cited

U.S. PATENT DOCUMENTS

| | | | | |
|---|---|---|---|---|
| 1,701,294 | A * | 2/1929 | Brochhausen | 49/238 |
| 2,432,881 | A * | 12/1947 | Hallmark et al. | 49/132 |
| 2,699,005 | A * | 1/1955 | Thomson | 49/106 |
| 3,722,140 | A * | 3/1973 | Newton | 49/30 |
| 5,299,882 | A * | 4/1994 | Sayers | 404/6 |
| 6,115,964 | A * | 9/2000 | Hix | 49/134 |
| 6,398,452 | B1 | 6/2002 | Wagner et al. | |
| RE39,170 | E | 7/2006 | Wagner et al. | |

FOREIGN PATENT DOCUMENTS

| | | |
|---|---|---|
| DE | 598432 | 6/1934 |
| GB | 2437408 | 10/2007 |
| GB | 0904316.7 | 5/2009 |
| GB | 0904316.7 | 6/2009 |
| WO | WO 97/47820 | 12/1997 |
| WO | WO 2007/119062 A1 | 10/2007 |
| WO | PCT/GB2010/000445 | 5/2010 |
| WO | PCT/GB2010/000445 | 4/2011 |

* cited by examiner

*Primary Examiner* — Jerry Redman
(74) *Attorney, Agent, or Firm* — Wells St. John P.S.

(57) ABSTRACT

An automatic gate opening device is claimed comprising: a gate drive axis (134), movable between a gate closed position and a gate open position; a treadle (102) and a rechargeable energy storage means (16, 118). The device also comprises an energy conversion means to convert stored energy into rotational movement of the drive axis (134) in a gate opening and energy conversion means to convert stored energy into rotational movement of the drive axis in a gate closing direction. The treadle (102) is configured such that, with the drive axis (134) in its gate open position, a single actuation of said treadle (102) recharges the energy storage means with sufficient energy to move the drive axis from its gate open position to its gate closed position and back to its gate open position.

21 Claims, 9 Drawing Sheets

MECHANISM FOR OPENING AND CLOSING BARRIER

CROSS REFERENCE TO RELATED APPLICATION

This application is a 35 U.S.C. §371 of and claims priority to PCT International Application Number PCT/GB2010/000445 (Publication No. WO 2010/103282A1), which was filed 11 Mar. 2010 (11 Mar. 2010), and was published in English, and this application claims priority to UK Patent Application No. 0904316.7 which was filed 13 Mar. 2009 (13 Mar. 2009), the teachings of which are incorporated herein by reference.

FIELD OF THE INVENTION

This application relates to a mechanism for opening and closing a barrier, in particular this mechanism related to an automatic gate opening device.

BACKGROUND OF THE INVENTION

Gates are commonly used in fence lines or farmyards to allow access and to secure vehicles, property or livestock.

However, for a vehicle to pass through the gate the driver has to vacate the vehicle to open the gate and then return it to the closed position once the vehicle has been driven through the gate. The opening and closing of gates can thus become time consuming.

Conventional gate opening mechanisms make use of electric motors in order to drive the opening and closing of the gate. Such mechanisms consume power and require connection to a power source upon installation, which can be problematic when the gate is to be installed a distance from the nearest premises or power lines. In addition, conventional powered gate mechanisms resist manual operation and thus inhibit use by pedestrians.

Some gate opening devices are known that utilise fluid power for opening and closing gates, the fluid being compressed by a vehicle driving over an actuator as it approaches a gate, the compressed fluid then opening a gate, and vice versa as the vehicle drives away from the gate. Although this goes some way to solving the problem if electrically powered gates problems arise when the gate borders directly a public road it is not usually possible to position the actuator in the public road. A further type of device is disclosed in the applicants prior PCT publication WO 2007/119062 which discloses a mechanical device that uses gravity to close the gate.

The present invention seeks to provide an improved mechanism for opening and closing a barrier.

BRIEF SUMMARY OF THE INVENTION

According to a first aspect of the present invention there is provided an automatic gate opening device comprising:

- a gate drive axis for driving a gate, movable between a gate closed position and a gate open position;
- a treadle;
- rechargeable energy storage means; energy conversion means to convert stored energy into rotational movement of the drive axis in a gate opening direction; and
- energy conversion means to convert stored energy into rotational movement of the drive axis in a gate closing;
- wherein the treadle is configured such that, with the drive axis in its gate open position, a single actuation of said treadle recharges the energy storage means with sufficient energy to move the drive axis from its gate open position to its gate closed position and back to its gate open position.

Preferably the rechargeable energy storage means comprises a pair of springs. More preferably the springs are spiral springs, preferably of the constant force type, which are charged in their extended state.

By the present invention the gate is already primed with sufficient energy to open the gate when it is in its closed position. When the gate is opened and a vehicle drives through, the weight of the vehicle passing over the treadle recharges the energy storage means so that they contain sufficient energy to close the gate and then to open it again when needed. By the provision of constant force type springs a constant closing force is applied. This ensures that, even if the shutting of the gate is halted, e.g. by a strong gust of wind, once the cause of the problem is removed, the gate will continue to be closed with the same force.

Preferably the rechargeable energy storage means further comprises a releasable latch mechanism for retaining each spring in its charged state. In this way the energy can be released to open or close the gate by means of a simple latch opening device that may be automated.

In a preferred arrangement the energy conversion means to convert stored energy into rotational movement of the drive axis in a gate closing direction comprises a first drive rod connected to the energy storage means and movable between an extended and a retracted position; and the energy conversion means to convert stored energy into rotational movement of the drive axis in a gate opening direction comprises a second drive rod connected to the energy storage means and movable between an extended and a retracted position. Preferably the drive rods are supported on linear bearings.

More preferably the automatic gate opening device further comprises: a first quadrant attached to the first drive rod, the first quadrant mounted on the same axis as the gate drive axis and rotateable relative thereto; a second quadrant attached to the second drive rod, the second quadrant mounted on the same axis as the gate drive axis and rotateable relative thereto; and a drive arm attached to the gate drive axis and extending therefrom, the drive arm having a drive pin attached to its distal end substantially perpendicular thereto, the drive pin configures such as to be driven by the first quadrant in one direction and by the second quadrant in the other direction. Preferably the first and second quadrant each comprise two arms extending from an axis of rotation substantially perpendicular one another and the arms may be at least partially connected by a web.

Preferably each quadrant has a driven arm and a driving arm, the driven arms connected to the drive rods at substantially the same distance from the gate drive axis. In this manner the same distance of movement of the drive rod will result in the same angular rotation of the gate drive axis.

In a preferred arrangement the driving arm of the second quadrant extends radially beyond the drive pin and is located such that when rotated it comes into contact with the drive pin, thereby rotating the drive arm, and preferably the driving arm of the first quadrant does not extend radially as far as the drive pin such that the drive arm of the first quadrant can freely rotate about the gate drive axis inside the arc of the drive pin, the driving arm of the first quadrant further comprising a ratchet mechanism extending from its distal end so as to allow the drive arm of the first quadrant to rotate freely inside the drive pin in a first direction and to engage with the drive pin when the first quadrant is rotated in a second direction. Preferably the automatic gate opening device further comprises a ratchet release mechanism that is activated when the gate is substantially in its closed position so as to disengage the drive pin from the ratchet mechanism.

In this manner the gate drive axis can me manually freely rotated from its closed position to its open position without effecting the drive mechanism.

In a preferred arrangement at least the latch associated with the spring that opens the gate is remotely releasable. More preferably at least the latch associated with the spring that opens the gate is electrically driven and has associated therewith a small power source and the latch is activated to release the spring by a wireless controller. In this manner a driver of a vehicle can remotely activate the latch so as to enable the gate to open without needing to get out of their vehicle or to drive it over any specific object.

In a preferred arrangement the latch associated with the spring that closes the gate is also electrically driven and is activated to release the spring by a wireless controller. In this manner a driver of a vehicle can remotely activate the latch so as to enable the gate to close without needing to get out of their vehicle or to drive it over any specific object. In an alternative arrangement the latch activates automatically a predetermined time interval after the gate is opened or after the latch associated with the spring that opens the gate is released. In this manner the driver need not take a specific action to cause the gate to close, merely they can drive through and continue with their journey and the gate will close of its own accord after the time interval has passed.

In a preferred arrangement the treadle is located substantially under the gate when the gate is in its closed position. Accordingly the treadle may be operated by the passage of a vehicle thereover as it passes through the gate.

In a preferred arrangement the treadle comprises a pivot lever therein for converting a lesser vertical movement into a greater horizontal movement. Preferably the horizontal movement displaces the springs into their charged position.

In one arrangement the automatic gate opening device further comprising a gate latch for, in use, maintaining the gate in its closed position, the gate latch being manually and remotely activated. In this manner the ratchet mechanism is be released as the gate enters its closed position and the gate will still be maintained in its closed position by virtue of the gate latch. If the gate is required to be manually operated the latch can be manually released and the gate opened. If the gate is to be automatically operated the gate latch will be automatically released, either shortly before, concurrent with, or shortly after the opening spring latch is released According to a second aspect of the invention there is provided a gate comprising an automatic gate opening device according to any preceding claim and a gate barrier having a free end and a pivoted end mounted thereon, the pivoted end being concentric with the gate drive axis.

Preferably the gate further comprises a gate post wherein the gate latch secures the free end of the gate to the gate post.

BRIEF DESCRIPTION OF THE SEVERAL VIEWS OF THE DRAWINGS

The invention will now be described, by way of example only, with reference to the drawings in which.

DETAILED DESCRIPTION OF THE INVENTION

Figure 1:
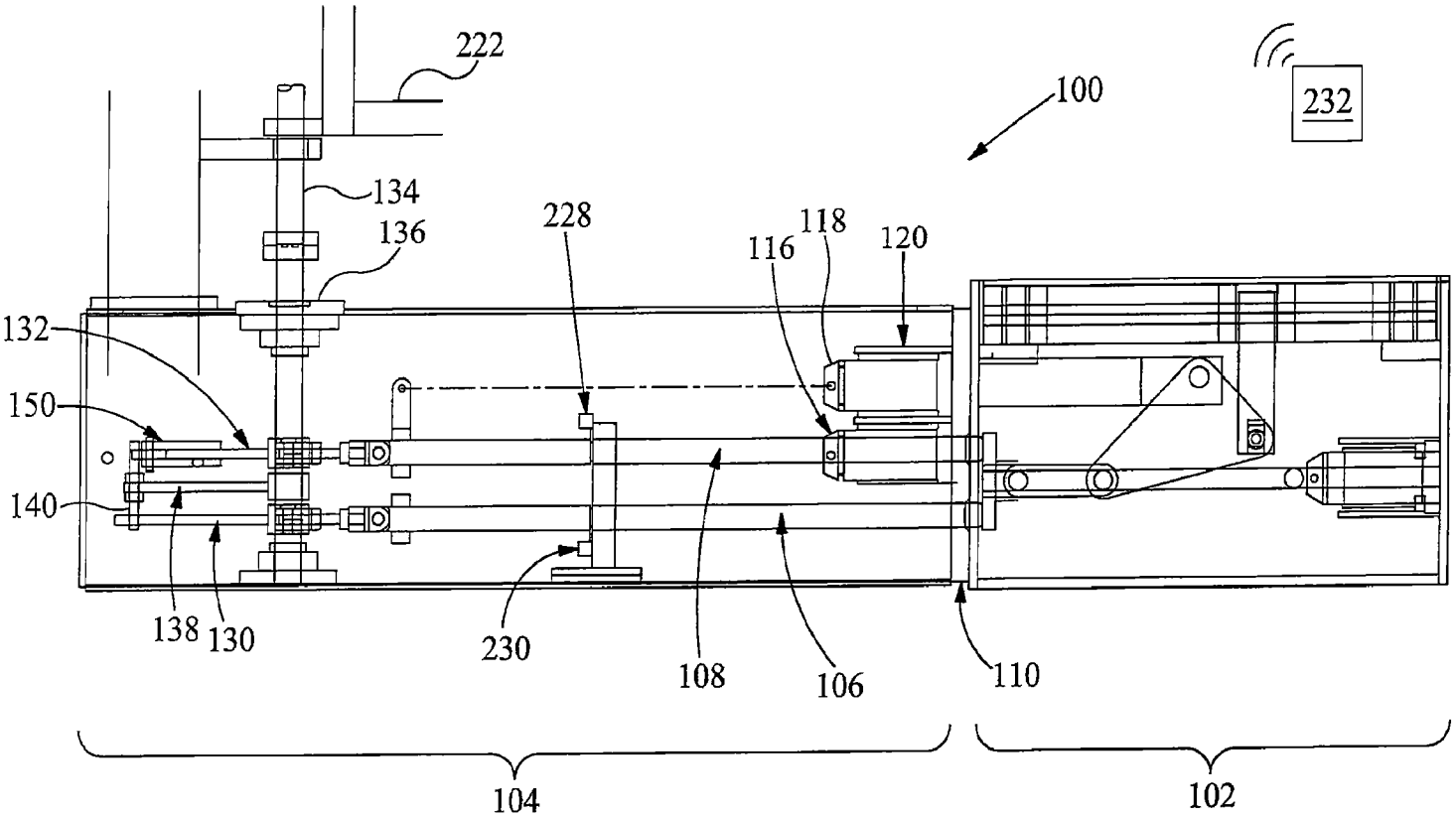
FIG. 1 shows a side view of a gate opening device in accordance with the invention.
Figure 2:
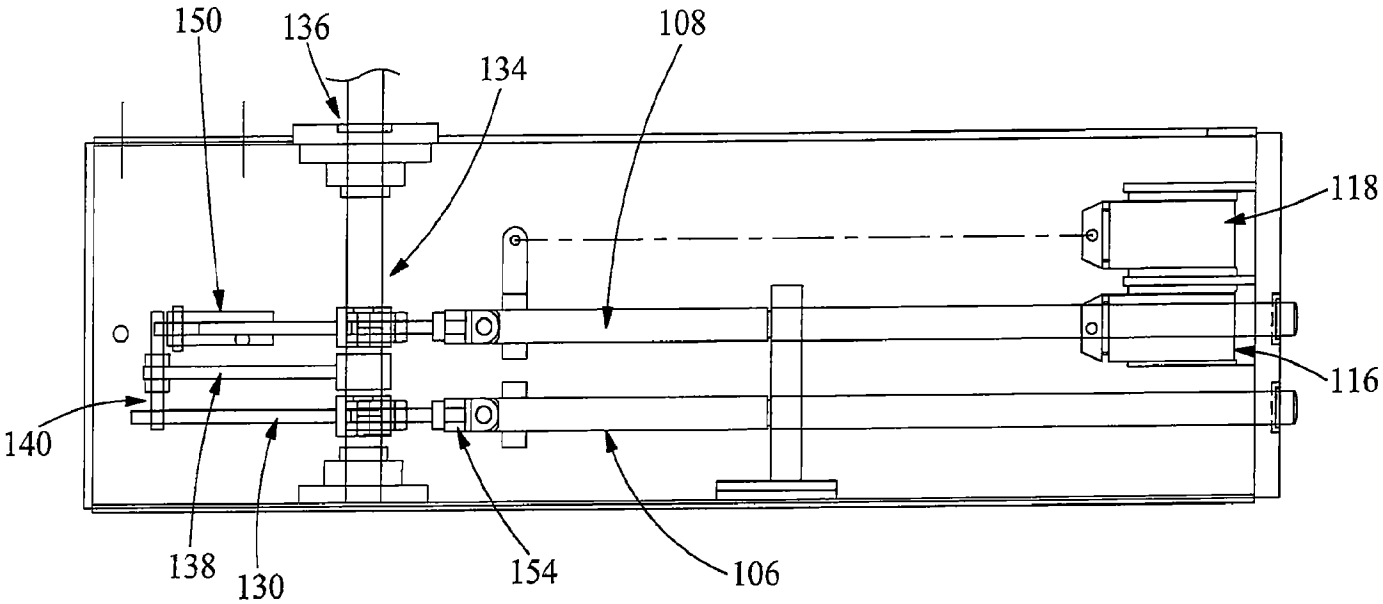
FIG. 2 shows a side view of the energy storage and conversion means of FIG. 1.
Figure 3:
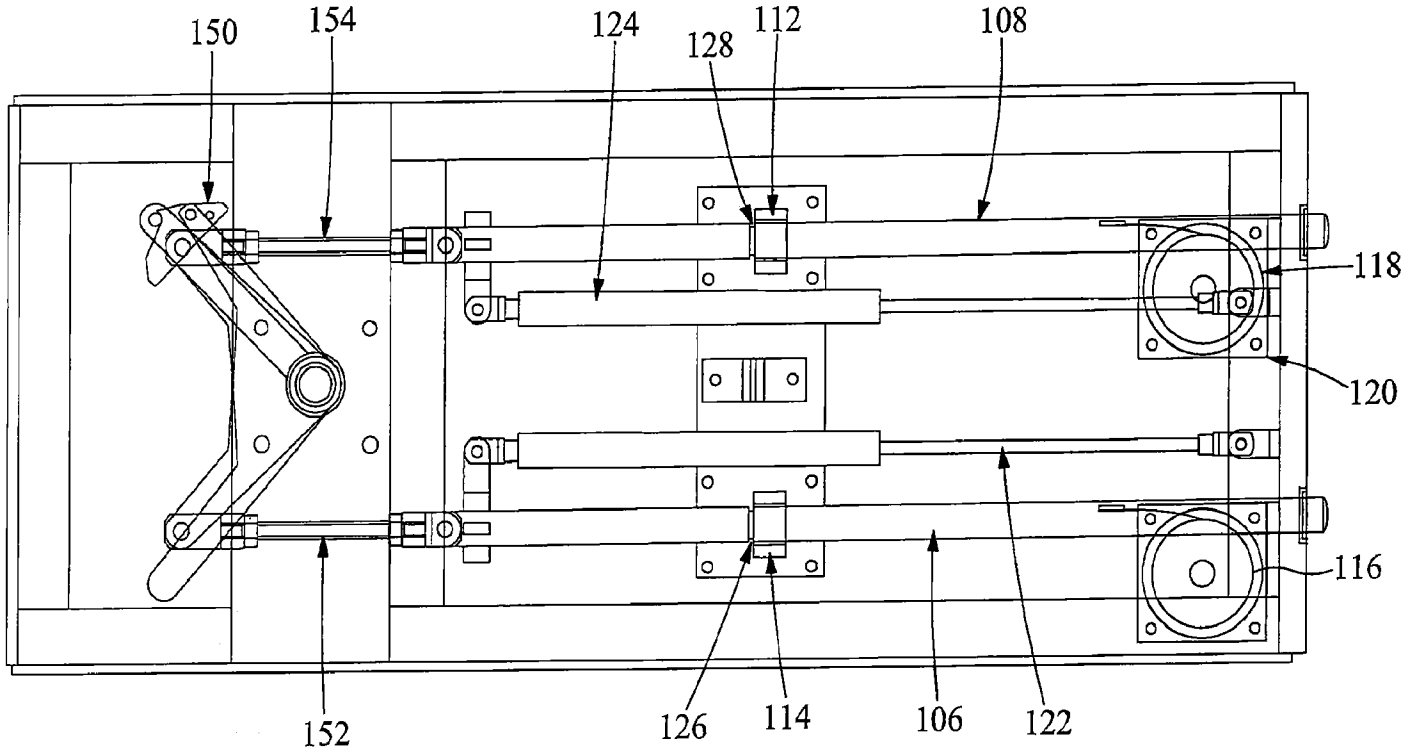
FIG. 3 shows a top view of the energy storage and conversion means of FIG. 1.
Figure 4:
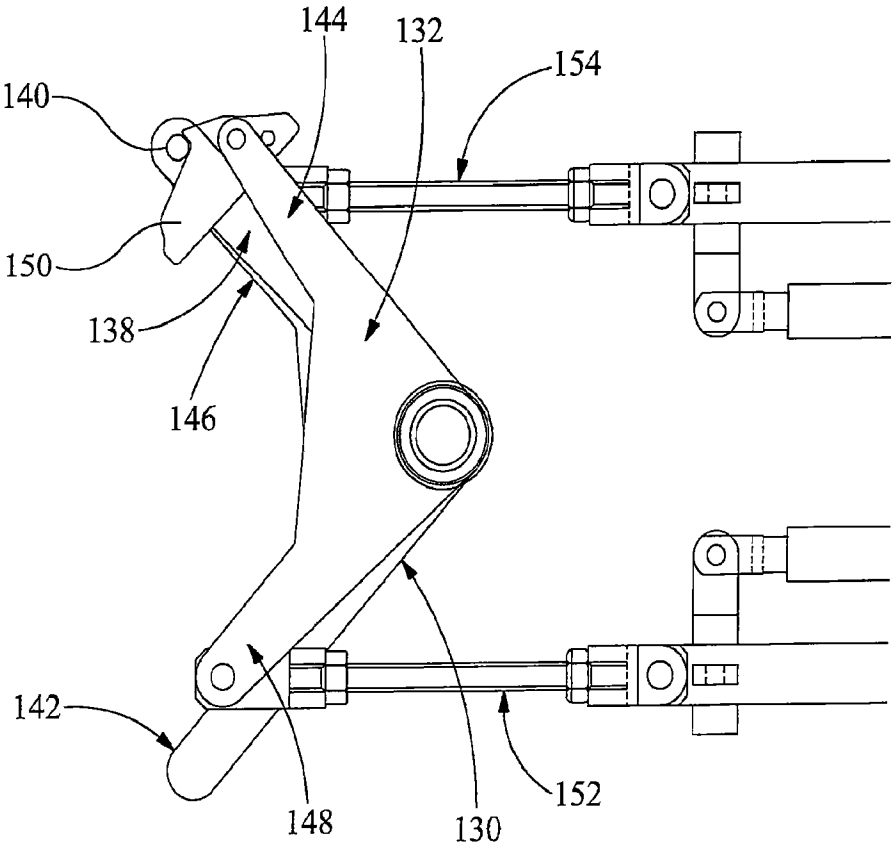
FIG. 4 shows an enlarged detail of FIG. 3.
Figure 6:
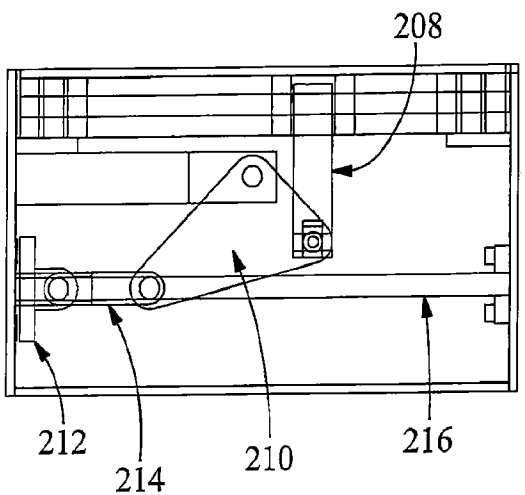
FIGS. 5 and 6 show side views of the treadle in its raised and depressed position respectively.
Figure 5:
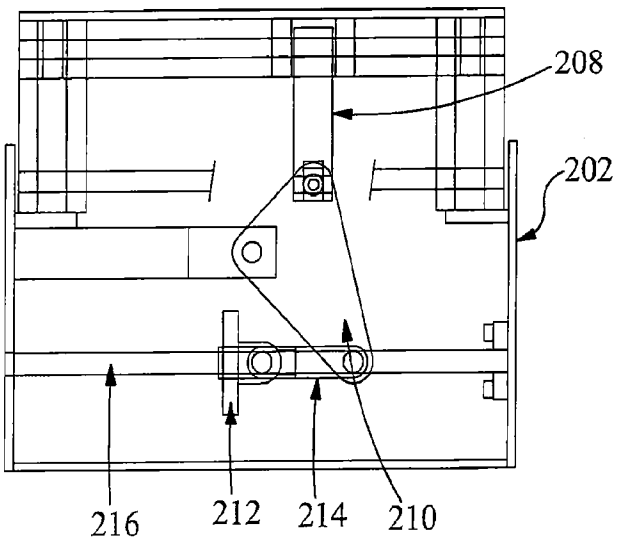
Figure 7:
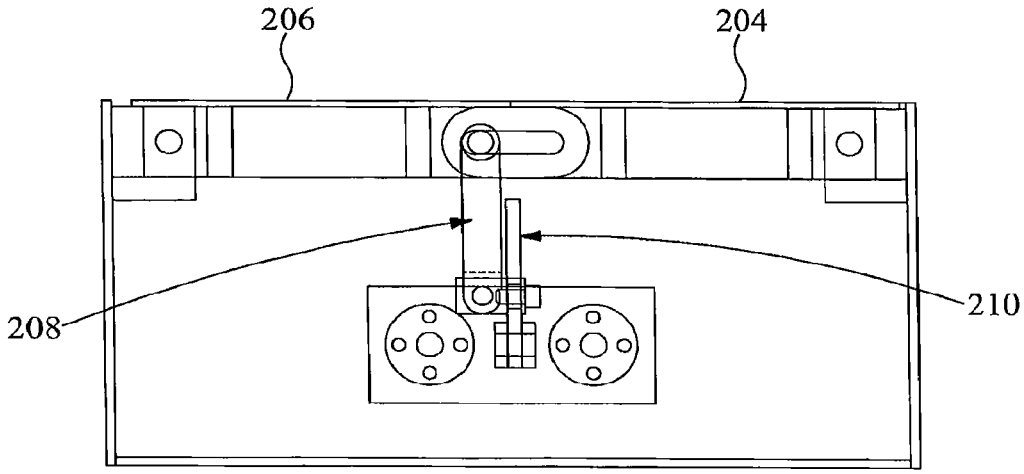
FIGS. 7 and 8 show end views of the treadle in its depressed and raised position respectively.
Figure 8:
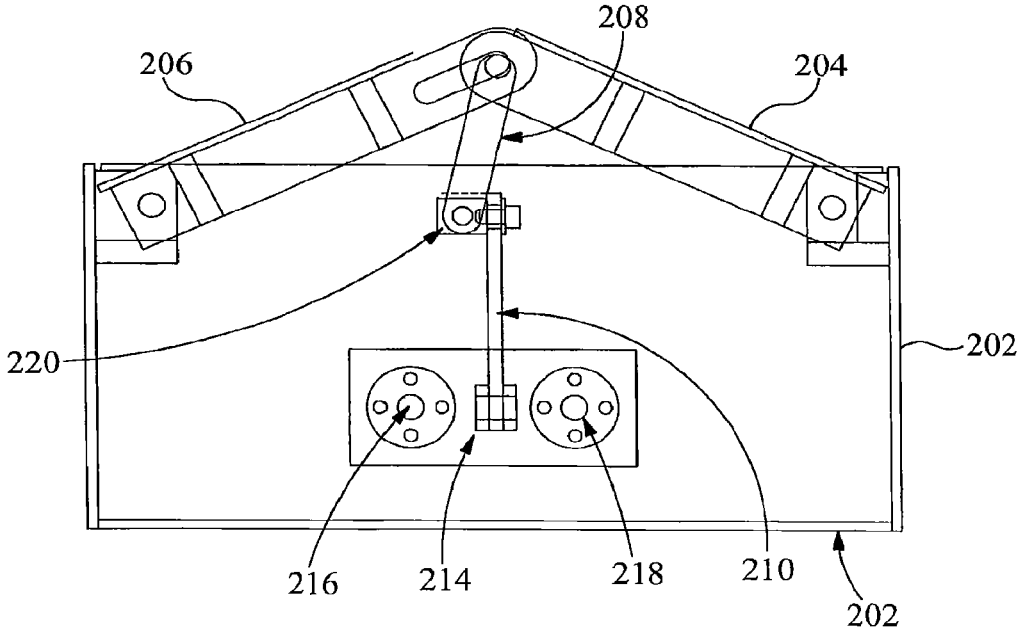

Referring to FIGS. 1 to 4 an automatic gate opening device 100 is shown comprising a treadle section 102 and a working section 104. The treadle 102 section is described in more detail with reference to FIGS. 4 to 6 below. The working section 104 has two drive rods 106 108 that protrude through a bulkhead 110 separating the working section 104 from the treadle section 102. The drive rods 106, 108 are supported in linear bearings 112, 114 in a manner in which they can pass therethrough in linear motion. The drive rods are parallel to one another and separated in the horizontal and vertical directions Energy storage means in the form of spiral springs 116, 118 are attached to a chassis 120 such that they can extend therefrom. The free end of each spiral springs is attached to the one of the drive rods 106, 108 such that the drive rods are biased by the springs towards a portion in which a greater proportion of the drive rods passes through the bulkhead. Each drive rod 106, 108 has a shock absorber 122, 124 attached thereto such that movement of the drive rods is dampened. The drive rods 106, 108 each have a groove 126, 128 therein into which a releasable latch 228, 230 can engage.

The drive rods 106, 108 are each connected to a quadrant 130, 132 via link arms 152 154. Each of the quadrants 130, 132 are arranged for rotation about gate drive axis 134. The gate drive axis is rotatable about its central axis in the bearing 136. A drive arm 138 is attached to the gate drive axis 134 such that it rotates with it. The drive arm is located in a horizontal plane interposed the two quadrants and has a drive pin 140 extending vertically upwards and downwards therefrom. Each quadrant has a driver arm 142, 144 which in use engages with the drive pin 140 and a driven arm 146 148 that is connected to a drive rod 106 108 by link arm 152 154. The driver arm and driven arm of each quadrant are joined to one another by a web. The driver arms 142, 144 of the two quadrants are of different lengths, one of which 142 extends from the gate drive axis 134 at least as far as the drive pin 140 such that movement of that driver arm acts directly on the drive pin 140. The other driver arm 144 is extends from the gate drive axis 134 to a distance short of the drive pin 140 such that it can rotate freely inside it. Driver arm 144 has a ratchet mechanism 150 attached to the distal end thereof and extending therefrom such that when the driver arm 144 is rotated in one direction the ratchet mechanism 150 engages with the drive pin 140, and when rotated in the opposite direction the ratchet mechanism 150 allows the driver arm 144 to rotate freely past the drive pin 140. The way in which the mechanism operates is described more fully with reference to FIGS. 8 to 12.

Referring now to FIGS. 5 to 8 the treadle unit 102 is shown in more detail. The treadle comprises an outer casing 202 and two activation surfaces 204 206 extending diagonally upwards therefrom. The activation surfaces 204 206 are pivotally attached to the casing 202 at their lower edges and are pivotally connected to one another in sliding arrangement at their upper edges such that when a mass is applied to the surfaces they can collapse from their extended position shown in FIG. 7 to their depressed position shown in FIG. 8. A treadle drive arm 208 joins the activation surfaces to a pivot lever 210 which is in turn joined to a drive plate 212 via a pivot link 214, the drive plate acting on the ends of the drive rods 106 108 which extend into the treadle unit 102. Drive plate 212 is supported on two horizontal guides 216 218 to locate in as it slides between its two positions.

The pivot lever 210 is substantially triangular in shape and is dimensioned such that the movement of the treadle drive arm is amplified into a greater movement of the drive rods 106 108. The treadle drive arm 208 is connected at either end via a universal joint 220. Spiral springs (omitted for clarity) are disposed within the casing 202 and are connected to the drive plate such that they are extended when the treadle surfaces 204 206 are depressed therefore providing a resilient force urging the drive plate 212 and the treadle surfaces 204 206 back to their original position.

Figure 9:
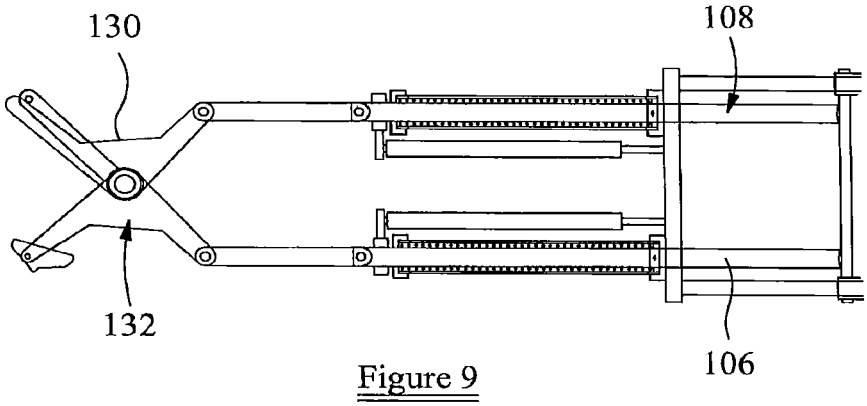
FIGS. 9 to 13 shows the sequence of operation of the gate opening device.
Figure 10:
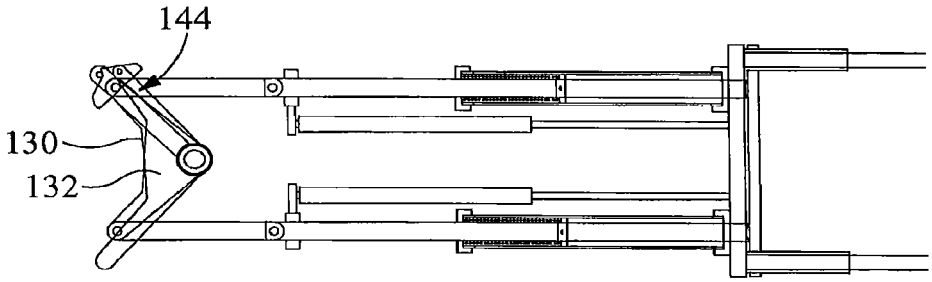

Referring now to FIGS. 9 to 14 the sequence of operation of the device is shown. In FIG. 9 the system is uncharged and the gate 222 is in the open position. A vehicle can then pass through the gate 222, depressing the treadle as it does so. As the treadle is depressed, the drive rods 106 108 are extended to and the associated springs are stretched. Quadrant 132 is rotated in a clockwise manner and quadrant 130 is rotated in a counter-clockwise direction and the components finish in the position shown in FIG. 10. As it does so the ratchet passes by the drive pin such that driver arm 144 is in a position in which counter-clockwise rotation thereof will cause the ratchet to engage with the drive pin thereby rotating the drive arm and gate drive axis. A latch mechanism engages with the drive rods to maintain them in position when the vehicle releases the treadle allowing the treadle to return to its extended position.

Figure 11:
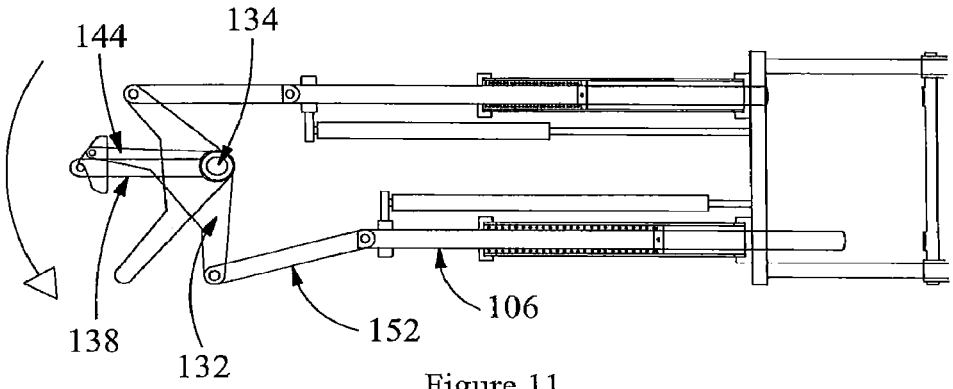
Figure 12:
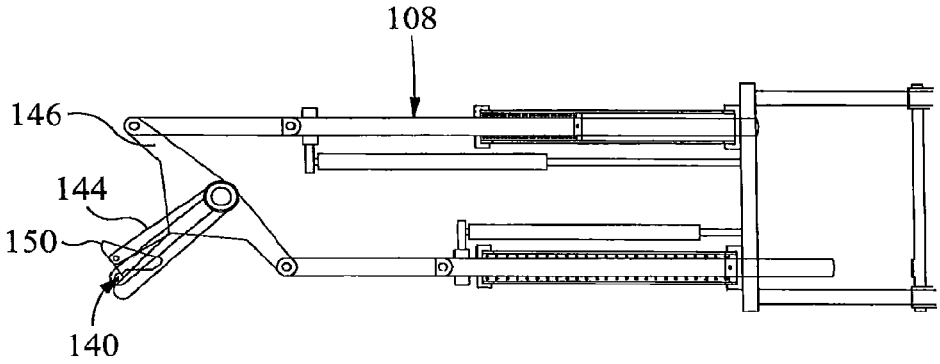

When remotely activated by a user (for example via a wireless controller 232) the latch 230 retaining drive rod 106, is released. Spring 116 (see FIG. 3) then acts on drive rod 108 causing it to move towards an unextended position. As the drive rod is attached to the driver arm 148 via link arm 152 the quadrant 132 also rotates moving the drive arm 138 and the gate drive axis 134 in a counter-clockwise direction as depicted in FIG. 11. At the end of its travel the quadrant has moved through approximately 90 degrees to the position shown in FIG. 11, thereby shutting the gate. As the drive arm 144 reaches the end of its travel the pawl of the ratchet 150 comes into contact with a disengager (omitted for clarity) which causes it to rotate about its pivot point and release the drive pin 140 therefrom, the components finishing in the position shown in FIG. 12. In this position a secondary latch mechanism 226 will activate on a gate post 224 to retain the gate 222 in its closed position. The secondary latch mechanism 226 is preferably a remotely activated latch and has a manual override such that pedestrians or drivers without a remote activator can still pass through the gate by opening it manually.

Figure 13:
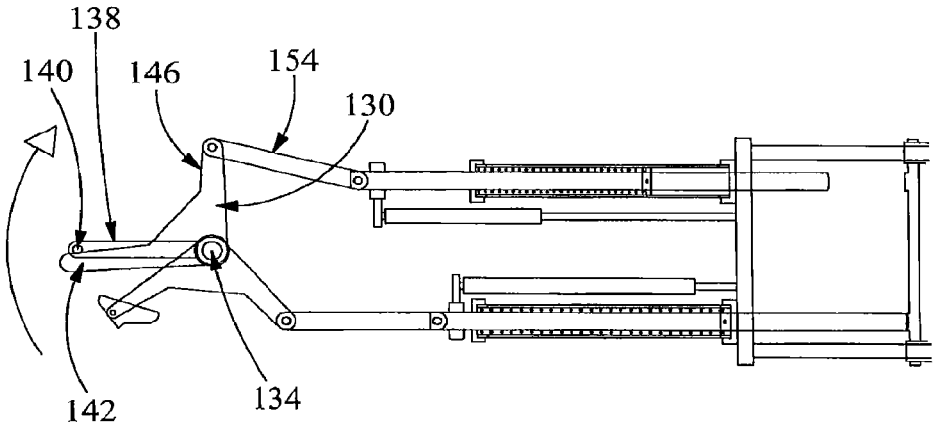
Figure 14:
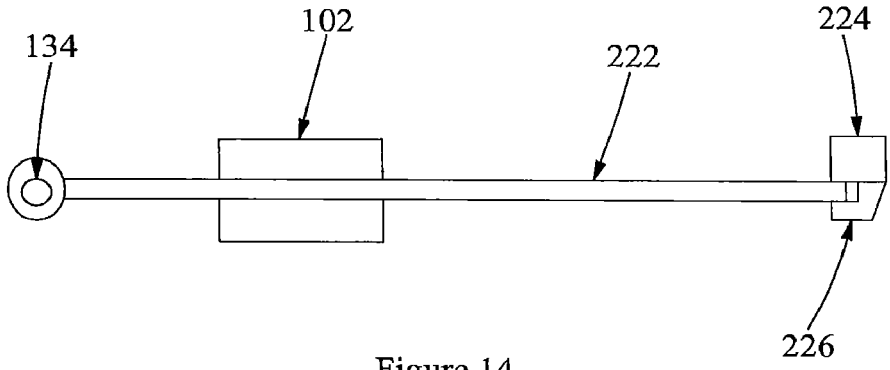
FIG. 14 shows a plan view of a gate of the invention.

When the gate 222 is required to be opened, the operator, via a remote activation means, activates the secondary latch 226 to release the gate from its position and also activates the latch, retaining drive rod 108, in its extended position. The two latches may be interlinked such that a single remote signal de activates both latches. Spring 118 (see FIG. 3) then acts on drive rod 108 causing it to move towards an unextended position. As the drive rod 108 is attached to the driven arm 146 via link arm 154 the quadrant 130 also rotates. The driver arm 142 acts on the drive pin 140 and moves the drive arm 138, and the gate drive axis 134, in a clockwise direction from a closed position towards an open position, as depicted in FIG. 13.

When the gate 222 is fully open the components are returned to the positions shown in FIG. 9.

It will be appreciated by the person skilled in the art that the use of directional terms, such as clockwise and counter-clockwise apply only to the embodiment depicted in the drawing to illustrate rotational movement in opposite directions and that the actual direction of movement could vary depending on the orientation of the gate and components relative one another and such alternative arrangements are encompassed by the scope of the invention.

The invention claimed is:

1. An automatic gate opening device comprising:

a gate drive axis, movable between a gate closed position and a gate open position;

a treadle;

rechargeable energy storage means;

energy conversion means to convert stored energy into rotational movement of the drive axis in a gate opening direction; and energy conversion means to convert stored energy into rotational movement of the drive axis in a gate closing direction;

wherein the treadle is configured such that, with the drive axis in said gate open position, a single actuation of said treadle recharges the energy storage means with sufficient energy to move the drive axis from said gate open position to said gate closed position and back to said gate open position wherein;

the rechargeable energy storage means comprises a pair of springs;

the energy conversion means to convert stored energy into rotational movement of the drive axis in said gate closing direction comprises a first drive rod connected to a first one of said pair of springs and movable between an extended and a retracted position;

the energy conversion means to convert stored energy into rotational movement of the drive axis in said gate opening direction comprises a second drive rod connected to a second one of said pair of springs and movable between an extended and a retracted position; and as the treadle is actuated the drive rods are extended and said springs are stretched.

2. An automatic gate opening device according to claim 1 wherein said springs are spiral springs which are in a charged state when extended.

3. An automatic gate opening device according to claim 1 wherein the rechargeable energy storage means further comprises a releasable latch mechanism for retaining each spring in said charged state.

4. An automatic gate opening device according to claim 3 wherein the releasable latch mechanism comprises a first latch for retaining the first one of said pair of springs in said charged state and the first latch is remotely releasable.

5. An automatic gate opening device according to claim 4 wherein the first latch for retaining the first one of said pair of springs in said charged state is electrically driven and has associated therewith a small power source and said first latch is activated to release the first one of said pair of springs by a wireless controller.

6. An automatic gate opening device according to claim 4 wherein the releasable latch mechanism comprises a second latch for retaining the second one of said pair of springs in said charged state and the second latch activates automatically a predetermined time interval after the gate drive axis reaches the gate open position or after said second latch for retaining the second one of said pair of springs is released.

7. An automatic gate opening device according to claim 1 wherein the drive rods are supported on linear bearings.

8. An automatic gate opening device according to claim 1 further comprising:

a first quadrant attached to the first drive rod, the first quadrant mounted on the same axis as the gate drive axis and rotateable relative thereto;

a second quadrant attached to the second drive rod, the second quadrant mounted co-axially with the gate drive axis and rotateable relative thereto; and a drive arm attached to the gate drive axis and extending therefrom, the drive arm having a drive pin attached to a distal end thereof, the drive pin being substantially perpendicular to the drive arm, the drive pin configured such as to be driven by the first quadrant in one direction and by the second quadrant in the other direction.

9. An automatic gate opening device according to claim 8 wherein the first and second quadrant each comprise two arms extending from an axis of rotation substantially perpendicular one another.

10. An automatic gate opening device according to claim 9 wherein the arms are at least partially connected by a web.

11. An automatic gate opening device according to claim 9 wherein each quadrant has a driven arm and a driving arm, the driven arms connected to the drive rods at substantially the same distance from the gate drive axis.

12. An automatic gate opening device according to claim 11 wherein the driving arm of the second quadrant extends radially beyond the drive pin and is located such that when rotated said driving arm of the second quadrant comes into contact with the drive pin, thereby rotating the drive arm.

13. An automatic gate opening device according to claim 12 wherein the driving arm of the first quadrant does not extend radially as far as the drive pin such that the drive arm of the first quadrant can freely rotate about the gate drive axis inside the drive pin, the driving arm of the first quadrant further comprising a ratchet mechanism extending from a distal end of said driving arm of the first quadrant so as to allow the drive arm of the first quadrant to rotate freely inside the drive pin in a first direction and to engage with the drive pin when the first quadrant is rotated in a second direction.

14. An automatic gate opening device according to claim 13 further comprising a ratchet release mechanism that is activated when the gate drive axis is substantially in said gate closed position so as to disengage the drive pin from the ratchet mechanism.

15. An automatic gate opening device according to claim 1 further comprising a gate and wherein the treadle is located substantially under the gate when the gate drive axis is in said gate closed position.

16. An automatic gate opening device according to claim 1 further comprising a gate and wherein the treadle is operated by passage of a vehicle thereover as said vehicle passes through the gate.

17. An automatic gate opening device according to claim 1 wherein the treadle comprises a pivot lever therein for converting a lesser vertical movement into a greater horizontal movement.

18. An automatic gate opening device according to claim 17 further comprising a gate and wherein the treadle is located substantially under the gate when the gate drive axis is in said gate closed position and wherein said horizontal movement displaces the springs into said charged state.

19. An automatic gate opening device according to claim 1 further comprising a gate and a gate latch, said gate latch for, in use, maintaining the gate in said gate closed position, the gate latch being both manually and remotely operable.

20. A gate comprising an automatic gate opening device according to claim 1, and a gate barrier having a free end and a pivoted end mounted thereon, the pivoted end being concentric with the gate drive axis.

21. A gate according to claim 20 further comprising a gate post and a gate latch, said gate latch for, in use, maintaining the gate in said gate closed position, the gate latch being both manually and remotely operable, and wherein the gate latch secures the free end of the gate to said gate post.

* * * * *

UNITED STATES PATENT AND TRADEMARK OFFICE

CERTIFICATE OF CORRECTION

PATENT NO. : 8,510,992 B2
APPLICATION NO. : 13/256423
DATED : August 20, 2013
INVENTOR(S) : James Goddard-Watts It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 62 days.

Signed and Sealed this
Fifteenth Day of September, 2015

Michelle K. Lee

Michelle K. Lee
*Director of the United States Patent and Trademark Office*